United States Patent [19]

Todd

[11] Patent Number: 4,971,209

[45] Date of Patent: Nov. 20, 1990

[54] BOTTLE STORAGE AND SERVING HOLDER

[76] Inventor: Richard Todd, 23 Davies La., Cobleskill, N.Y. 12043

[21] Appl. No.: 741,488

[22] Filed: Jun. 5, 1985

[51] Int. Cl.[5] ..... A47B 73/00

[52] U.S. Cl. ..... 211/74; 248/311.3

[58] Field of Search ..... 211/74; 248/311.3, DIG. 9

[56] References Cited

U.S. PATENT DOCUMENTS

| | | | |
|---|---|---|---|
| 2,111,357 | 3/1938 | Cornell, Jr. | 248/DIG. 9 |
| 2,419,040 | 4/1947 | Stepanian | 248/311.3 X |
| 2,899,079 | 8/1959 | Davis | 211/74 |
| 3,131,829 | 5/1964 | Masser . | |
| 3,194,426 | 7/1965 | Brown, Jr. . | |
| 3,241,661 | 3/1966 | Zamzow et al. | 206/433 |
| 3,514,064 | 5/1970 | Katz | 248/311.3 |
| 3,982,716 | 9/1976 | Trees | 248/311.3 X |
| 4,253,830 | 3/1981 | Kazen et al. | 211/69 X |

FOREIGN PATENT DOCUMENTS

| | | | |
|---|---|---|---|
| 318755 | of 1903 | France | 248/311.3 |

*Primary Examiner*—Blair M. Johnson

*Attorney, Agent, or Firm*—Schmeiser, Morelle & Watts

[57] ABSTRACT

A bottle storage and serving holder for supporting bottles in an inverted position. A unitary structure with a top surface and side surfaces defining a centrally hollow area with an opened bottom portion. The top surface has a plurality of openings with each opening offset from adjacent openings. An adjustment bar secured to a side wall is positioned perpendicular to the top surface.

3 Claims, 1 Drawing Sheet

BOTTLE STORAGE AND SERVING HOLDER

Field of the Invention

This invention relates to bottle holders and storage racks. More specifically, this invention relates to such holders and racks which support bottles in an inverted position.

Background of the Invention

Over the years, numerous devices have been developed to support and store bottles. These devices range from wine racks to biological storage racks with each containing specific features to improve the application of the support to its specific purpose.

With regard to those devices which support bottles in their inverted position, there are a variety of applications. For example, some wine racks will also hold bottles in an inverted position in order to guarantee that the cork remains moist. In other situations, one bottle may be held in an inverted position while another is supported in an upright position beneath it, thereby allowing the inverted bottle to drain its contents into the upright receptacle. Other devices hold the bottles in an inverted position for sterilizing or simply for storage.

In order to accomplish these various purposes, the support structures of the prior art have a variety of features. Some utilize additional compartments about the bottles which can be filled with ice while others attach the bottles to additional apparatus to provide for dispensing of the contents. Supports which hold bottles for sterilizing are generally open structures which allow a complete washing and cleaning of the bottle followed by drainage of the washing medium. In many of the above described situations, the bottle holders are designed to accommodate a specific type of bottle, the dimensions and configurations of which vary only slightly and within certain reasonable limits.

Thus, one of the most significant needs for a bottle holder for supporting bottles in an inverted position has gone largely unnoticed. This, of course, relates to the home use of a bottle holder for draining the last remaining contents of the bottle to the capped outlet. Of course, this covers a wide range of bottle configurations and sizes, although most will be familiar with the inversion of bottles that contain ingredients such as catsup or salad dressing.

The holders heretofore known have a number of disadvantages if one were to attempt to use them for home usage as described above. Most important is their inability to be securely positioned both within a refrigerator and upon a serving table. This is especially true since it is important to prevent airlocks within the bottles being drained and to help drainage by moving the bottles, which problem can be solved by placing the holder on shelves secured to the refrigerator door.

It is, therefore, an object of this invention to provide a new and improved bottle holder for supporting bottles in an inverted position of utility especially in homes where the holder is moved between a refrigerator and a serving table.

Another object of this invention is to provide a new and improved bottle holder which may be secured upon a shelf within a refrigerator door.

Another object of this invention is to provide a new and improved bottle holder which is easy to clean.

A still further object of this invention is to provide a new and improved bottle holder which is sufficiently versatile to hold a wide variety of bottle configurations and sizes.

Another object of this invention is to provide a new and improved bottle holder which insulates the bottle neck and its contents when used outside of the refrigerator.

Another object of this invention is to provide a new and improved bottle holder which is inexpensive to manufacture and easy to use.

Objects and advantages of the invention are set forth in part herein and in part will be obvious herefrom, or may be learned by practice with the invention, the same being realized and obtained by means of the instrumentalities and combinations pointed out in the appended claims.

The invention consists in the novel parts, constructions, arrangements, combinations and improvements herein shown and described.

Summary of the Invention

It has been found that the objects of this invention may be realized by forming, preferably by molding, the bottle holder from a polystyrene type material having a top surface and four supporting sides which are continuous and thereby define a hollow central portion. The top surface has a plurality of two inch circular openings with each opening offset from all adjacent openings so as to provide sufficient room for bottles of various configurations. Advantageously, an adjustment bar extends along one of the side surfaces in a position which is perpendicular to the top surface. This adjustment bar is adapted for removal if necessary for properly securing the holder upon a refrigerator door shelf. The bottom of the holder is open so that any drippings from the bottles will simply fall upon the refrigerator shelf which is easily cleansible.

The bottle holder described herein provides a remarkably effective way for utilizing the entire contents of a bottle while being inexpensive to manufacture and easy to use. The adjustment bar allows for the use of the subject invention on refrigerator doors wherein the shelves are of varying sizes. The polystyrene type material which is used provides insulation of the necks of the bottles wherein the contents accumulate. In addition, the polystyrene is at least partially deformable so as to sufficiently hold the bottles in place.

It will be understood that the foregoing general description and the following detailed description as well are exemplary and explanatory of the invention but are not restrictive thereof. The accompanying drawings referred to herein and constituting a part hereof, illustrate the preferred embodiment of the invention, and together with the description, serve to explain the principles of the invention.

Figure 1:
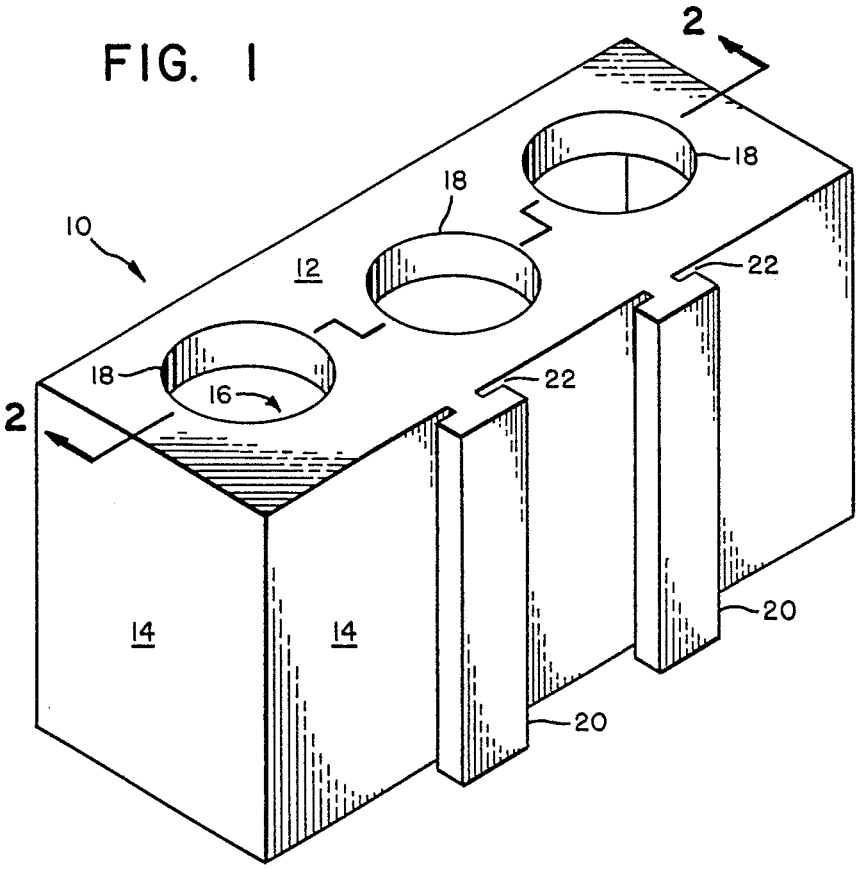
FIG. 1 is a perspective view of the invention.

FIG. 1 discloses the bottle holder generally designated as 10. The main body of the holder consists of a top surface 12 and side surfaces 14, joined together so as to form a substantially rectangular body. The side surfaces are solid and continuous so as to aid in the insulation of the necks of the bottles which extend into the hollow central area 16 which is defined by the surfaces.

The top surface has a plurality of circular openings 18 which in my preferred embodiment are two inches in diameter. The openings 18 extend through to the hollow 16 and are arranged so that each opening 18 is offset from any adjacent openings. The offsetting of the openings allows for the placement of bottles of varying shapes and sizes without interference.

Along one of these side surfaces 14 are adjustment bars 20. These adjustment bars are narrow at 22 so as to facilitate their removal should it be necessary for placement of the holder 10 within a refrigerator door. The adjustment bars 20 are aligned perpendicular to the top surface so as to assure contact with the retaining rail common on refrigerator doors.

Figure 2:
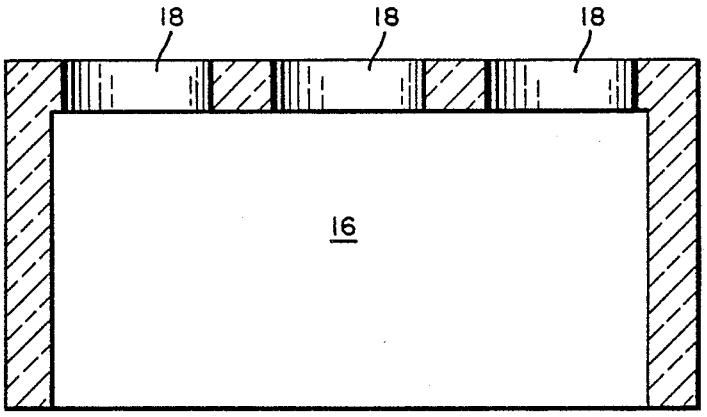
FIG. 2 is a cross-sectional view taken along lines 2—2 of FIG. 1.

As shown in FIG. 2, the top and sides are sufficiently thick so as to provide insulation when the holder is made of polystyrene or a similar material. Thus, if the holder is taken from the refrigerator and placed on a table, the insulation serves to reduce the warming of the necks of the bottles in which the remaining contents reside.

As also shown in FIG. 2, the bottom of the holder is opened so that any contents leaking from the bottles will simply fall upon the refrigerator shelf or table top which can be easily cleaned.

The invention in its broader aspects is not limited to the specific embodiments herein shown and described, but departures may be made therefrom within the scope of the accompanying claims, without departing from the principles of the invention and without sacrificing its chief advantages. For example, it would be possible to place handles within the side surfaces 14 for easy handling of the holder. In addition, other similar changes will become apparent as one familiarizes himself with the invention.

I claim:

1. A bottle storage and serving holder for supporting bottles in an inverted position comprising:

a body member having top and side surfaces, said top surface having at least one hole disposed therethrough; and at least one bar secured to one of the side surfaces and extending outwardly therefrom wherein said at least one bar is removably secured perpendicular to the top surface for altering the width of the holder.

2. The invention of claim 1 wherein the sides of the body are solid and continuous, said sides defining a hollow central chamber covered by the top surface and opened at the bottom, and wherein said bar narrows towards its point of attachment with the side surfaces.

3. The invention of claim 1 wherein the body is polystyrene and the top surface has a plurality of circular openings substantially two inches in diameter, each of said openings being offset from adjacent openings.

* * * * *